US009812272B1

(12) United States Patent
Wachinger

(10) Patent No.: US 9,812,272 B1
(45) Date of Patent: Nov. 7, 2017

(54) OPERATOR CONTROL DEVICE FOR A VEHICLE, IN PARTICULAR A PASSENGER MOTOR VEHICLE

(71) Applicant: AUDI AG, Ingolstadt (DE)

(72) Inventor: Michael Wachinger, Winkelhausen (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 15/523,601

(22) PCT Filed: Nov. 27, 2015

(86) PCT No.: PCT/EP2015/002386
§ 371 (c)(1),
(2) Date: May 1, 2017

(87) PCT Pub. No.: WO2016/096087
PCT Pub. Date: Jun. 23, 2016

(30) Foreign Application Priority Data

Dec. 19, 2014 (DE) ..... 10 2014 019 248

(51) Int. Cl.
*H01H 13/26* (2006.01)
*H01H 13/14* (2006.01)
(Continued)

(52) U.S. Cl.
CPC ..... *H01H 13/14* (2013.01); *H01H 13/10* (2013.01); *H01H 13/22* (2013.01); *H01H 13/50* (2013.01);
(Continued)

(58) Field of Classification Search
CPC ..... H01H 13/26; H01H 13/22; H01H 13/20; H01H 13/52; H01H 13/50;
(Continued)

(56) References Cited

U.S. PATENT DOCUMENTS 4,390,765 A * 6/1983 Sado ..... H01H 13/702 200/513
4,518,833 A * 5/1985 Watkins ..... H01H 13/702 200/265
(Continued)

FOREIGN PATENT DOCUMENTS

DE 31 45 130 A1 6/1982
DE 93 02 229 U1 4/1993
(Continued)

OTHER PUBLICATIONS

English translation of International Preliminary Report on Patentability dated Jun. 22, 2017 from International Patent Application No. PCT/EP2015/002386, 7 pages.
(Continued)

*Primary Examiner* — Felix O Figueroa
(74) *Attorney, Agent, or Firm* — Staas & Halsey LLP

(57) ABSTRACT

A base element and at least one switching element are included in an operator control device which may be disposed in a vehicle. By closing at least one electrical contact, the switching element is moveable from a first position into a second position relative to the base element. The operator control device can also include at least one pushbutton switch moveable relative to the base element between a position of rest and at least one activation position. The operator control device can further include at least one restoring element, formed of silicone and supported on the base element and on the pushbutton switch, which can be elastically deformed by moving the pushbutton switch from the position of rest into the activation position. Using the restoring element, the pushbutton switch can be moved from the activation position into the position of rest by relaxing the restoring element.

16 Claims, 2 Drawing Sheets

(51) Int. Cl.
*H01H 13/50* (2006.01)
*H01H 13/10* (2006.01)
*H01H 13/52* (2006.01)
*H01H 13/22* (2006.01)

(52) U.S. Cl.
CPC ..... *H01H 13/52* (2013.01); *H01H 2215/006* (2013.01); *H01H 2221/036* (2013.01); *H01H 2221/044* (2013.01); *H01H 2227/032* (2013.01); *H01H 2227/034* (2013.01); *H01H 2231/026* (2013.01); *H01H 2237/006* (2013.01); *H01H 2237/008* (2013.01)

(58) Field of Classification Search
CPC ..... H01H 2237/006; H01H 2237/008; H01H 2237/00; H01H 2235/008; H01H 2227/032; H01H 2227/034; H01H 2221/044; H01H 2221/036
See application file for complete search history.

(56) References Cited

U.S. PATENT DOCUMENTS 4,584,444 A * 4/1986 Nagashima ..... H03K 17/975 200/276.1
4,604,509 A 8/1986 Clancy et al.
4,814,561 A * 3/1989 Kawasaki ..... H01H 13/702 200/5 A
4,851,626 A * 7/1989 Nagashima ..... H01H 13/52 200/513
5,389,757 A 2/1995 Souliere
5,612,692 A * 3/1997 Dugas ..... H01H 13/705 200/5 B

FOREIGN PATENT DOCUMENTS

| | | | |
|---|---|---|---|
| DE | 691 06 745 | T2 | 6/1995 |
| DE | 600 20 285 | T2 | 11/2005 |
| DE | 10 2014 019 2 | | 12/2014 |
| GB | 2 055 510 | A | 3/1981 |
| WO | 2011/007500 | A1 | 1/2011 |
| WO | PCT/EP2015/002386 | | 11/2015 |

OTHER PUBLICATIONS

German Office Action dated Sep. 1, 2015 from German Patent Application No. 10 2014 019 248.2, 5 pages.
German Office Action dated Jun. 20, 2016 from German Patent Application No. 10 2014 019 248.2, 5 pages.
International Search Report dated Mar. 21, 2016 from International Patent Application No. PCT/EP2015/002386, 2 pages.

* cited by examiner

OPERATOR CONTROL DEVICE FOR A VEHICLE, IN PARTICULAR A PASSENGER MOTOR VEHICLE

CROSS REFERENCE TO RELATED APPLICATIONS

This application is the U.S. national stage of International Application No. PCT/EP2015/002386, filed on Nov. 27, 2015. The International Application claims the priority benefit of German Application No. 10 2014 019 248.2 filed on Dec. 19, 2014. Both the International Application and German Application are incorporated by reference herein in their entirety.

BACKGROUND

Described herein is an operator control device for a vehicle. Furthermore, described herein is a motor vehicle, in particular a passenger motor vehicle, having the operator control device.

Such operator control devices for vehicles, in particular motor vehicles such as, for example, passenger motor vehicles, are already known from the general related art as well as, in particular, from series manufacture of vehicles. Such an operator control device includes a base element and at least one switching element which is secured, for example, to the base element. The switching element can be moved relative to the base element by closing at least one electrical contact from a first position into at least a second position. The operator control device also includes at least one pushbutton switch which can be moved relative to the base element in a movement direction between a position of rest and at least one activation position. By using the pushbutton switch, the switching element can be moved from the first position into the second position by the pushbutton switch being moved from its position of rest into its activation position. In other words, the switching element can be moved by the pushbutton switch, with the result that the electrical contact can be closed by the switching element and the pushbutton switch.

The operator control device also includes at least one restoring element which is supported on the base element and on the pushbutton switch and can be elastically deformed by moving the pushbutton switch from the position of rest into the activation position. The pushbutton switch can be moved from the activation position into the position of rest by using the restoring element, by at least partially relaxing the restoring element. In other words, the restoring element is elastically deformed in the activation position of the pushbutton switch and as a result is tensioned or charged, and the pushbutton switch which is in the activation position is therefore subjected to a force, in particular a spring force, by using the restoring element which is supported on the pushbutton switch. By using this force, the pushbutton switch is moved from the activation position back into the position of rest, wherein the restoring element at least partially relaxes, i.e. is at least partly deformed back. The switching element is, for example, a further pushbutton switch which can move back from the second position into the first position if the first pushbutton switch is moved from the activation position into the position of rest.

The pushbutton switch forms, for example, a surface of the operator control device, wherein a person, for example a vehicle occupant and, in particular, the driver of the vehicle, touches the surface in order to move the pushbutton switch from the position of rest into the activation position. To do this, the person applies a force to the pushbutton switch, for example by using one of their fingers, by using which force the pushbutton switch is moved into the activation position counter to the force of the restoring element.

In the position of rest, the pushbutton switch is spaced apart, for example, from the switching element. On its way from the position of rest into the activation position, before the pushbutton switch reaches its activation position it abuts against the switching element in a supported fashion with the result that the switching element is then moved together with the pushbutton switch into its activation position. As a result, the switching element is ultimately moved from its first position into its second position. The pushbutton switch is used, in particular, in order to make available a particularly large surface which can be touched by the person, with the result that simple and comfortable operator control of the operator control device can be implemented.

However, for example, it has become apparent that an unfavorable force profile can occur during the movement of the pushbutton switch from the position of rest into the activation position, in particular when the pushbutton switch carries out a relatively long stroke between the position of rest and the activation position and/or there is a large distance between the pushbutton switch and the switching element in the position of rest of the pushbutton switch. This unfavorable force profile can give rise to imprecise and, in particular, unpleasant operator control of the operator control device.

SUMMARY

Described herein is an operator control device of the type mentioned at the beginning in such a way that precise and particularly advantageous operator control of the operator control device can be implemented.

This object is achieved by an operator control device having the features of patent claim 1. Advantageous refinements with expedient developments are described herein.

The operator control device for a vehicle described herein, in particular a motor vehicle such as, for example, a passenger motor vehicle, includes a base element as well as at least one switching element which, by closing at least one electrical contact, can be moved relative to the base element from a first position into at least a second position. The operator control device also includes at least one pushbutton switch which can be moved relative to the base element in a movement direction between a position of rest and at least one activation position, by which the pushbutton switch can move the switching element from the first position into the second position by moving the pushbutton switch from the position of rest into the activation position.

In addition, the operator control device includes at least one restoring element which is supported on the base element and on the pushbutton switch and can be elastically deformed by moving the pushbutton switch from the position of rest into the activation position and by which restoring element the pushbutton switch can be moved from the activation position into the position of rest by at least partially relaxing the restoring element.

In order then to implement particularly precise and advantageous operator control of the operator control device, there is provision described herein that the restoring element is formed from silicone. Such a silicone is understood to be, in particular, a polysiloxane or a polyorganosiloxane and denotes a group of synthetic polymers in which silicon atoms are linked by using oxygen atoms. A particularly advantageous deformation behavior of the restoring element can be implemented by the restoring element which is formed from silicone, with the result that a particularly advantageous force profile can be implemented during the movement of the pushbutton switch from the position of rest into the activation position and during the associated elastic deformation of the restoring element. This force profile can be perceived as being particularly pleasant and of high quality by, for example, a person who moves the pushbutton switch from the position of rest into the activation position and in doing so elastically deforms the restoring element, with the result that particularly advantageous and precise operator control of the operator control device can be implemented. In particular, particularly advantageous operator control of the operator control device can be implemented by the restoring element which is formed from silicone compared to restoring elements which are formed from metallic substances.

It has proven particularly advantageous if, when the pushbutton switch moves from the position of rest into the activation position along the movement direction, it travels a distance, wherein the restoring element is embodied in such a way that a force for moving the pushbutton switch from the position of rest into the activation position increases linearly at least in a part, and for example at least in a major part, of the distance with increasing movement of the pushbutton switch in the direction of the activation position. In other words, in order to move the pushbutton switch from the position of rest into the activation position and at the same time elastically deform the restoring element, a person applies a force to the pushbutton switch, for example by using one of their fingers. By using this force, the pushbutton switch is moved over the specified distance from the position of rest into the activation position. As the distance increases, that is to say as the movement of the pushbutton switch from the position of rest in the direction of the activation position increases, the restoring element is increasingly deformed, with the result that the force also increases or has to increase. In this context, the restoring element may be configured in such a way that the force which must be applied to the pushbutton switch to move the pushbutton switch from the position of rest into the activation position increases or has to increase linearly, at least in part of the distance and for example at least in a major part of the distance. As a result, particularly precise, pleasant and high-quality operator control of the operator control device can be implemented.

In one particularly advantageous embodiment there is provision that the restoring element has a cross section which is embodied in a varying fashion along the movement direction. In other words, the cross section is not constant, but rather varies, along the movement direction and along an extent of the restoring element. As a result, the deformation behavior of the restoring element can be adjusted particularly in accordance with the requirements, and, for example, a linear force profile can therefore be implemented. The force profile is to be understood as being a profile of the force for moving the pushbutton switch from the position of rest into the activation position over the distance.

A further embodiment is characterized by the fact that the restoring element is embodied in the form of a truncated cone at least in a partial region. It has been found that such a configuration of the restoring element in the form of a truncated cone permits the formation of a particularly advantageous force profile, with the result that the force profile or at least part of the distance can be configured, for example, at least essentially linearly.

In order to implement a particularly advantageous force profile and therefore particularly advantageous operator control of the operator control device, in a further embodiment there is provision that the restoring element has at least one recess on an end side facing the pushbutton switch. In this context, there can be provision that the pushbutton switch is arranged at least partially in the recess.

It has also proven particularly advantageous if the recess tapers along the movement direction. There is provision that the recess tapers in a direction pointing away from the pushbutton switch, and for example, along the movement direction. As a result, particularly precise and high-quality operator control of the operator control device can be implemented.

It has proven particularly advantageous if the recess has a base and a side wall which adjoins the base, wherein the base and the side wall are formed by the restoring element which may be embodied in one piece. The side wall is adjoined by a wall region of the restoring element, wherein the wall region extends obliquely with respect to the movement direction. As a result, the deformation behavior of the restoring element can be adjusted particularly advantageously, with the result that a particularly advantageous and pleasant force profile can be implemented.

In one particularly advantageous refinement, a projection, projecting in the direction of the pushbutton switch, of the restoring element is arranged in the recess. For example, the projection is spaced apart, perpendicularly with respect to the movement direction, from a wall region, adjoining the recess, of the restoring element. Such a configuration of the restoring element makes it possible to adjust its deformation behavior particularly in accordance with requirements, with the result that, for example, an at least essentially linear force profile can be formed.

Finally, it has proven particularly advantageous if the projection projects out of the recess, as a result of which particularly advantageous operator control of the operator control device can be implemented.

Also described herein is a vehicle, in particular a motor vehicle and preferably a passenger motor vehicle, having at least one operator control device as described herein. Advantages and advantageous refinements of the operator control device are to be considered advantages and advantageous refinements of the vehicle, and vice versa.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
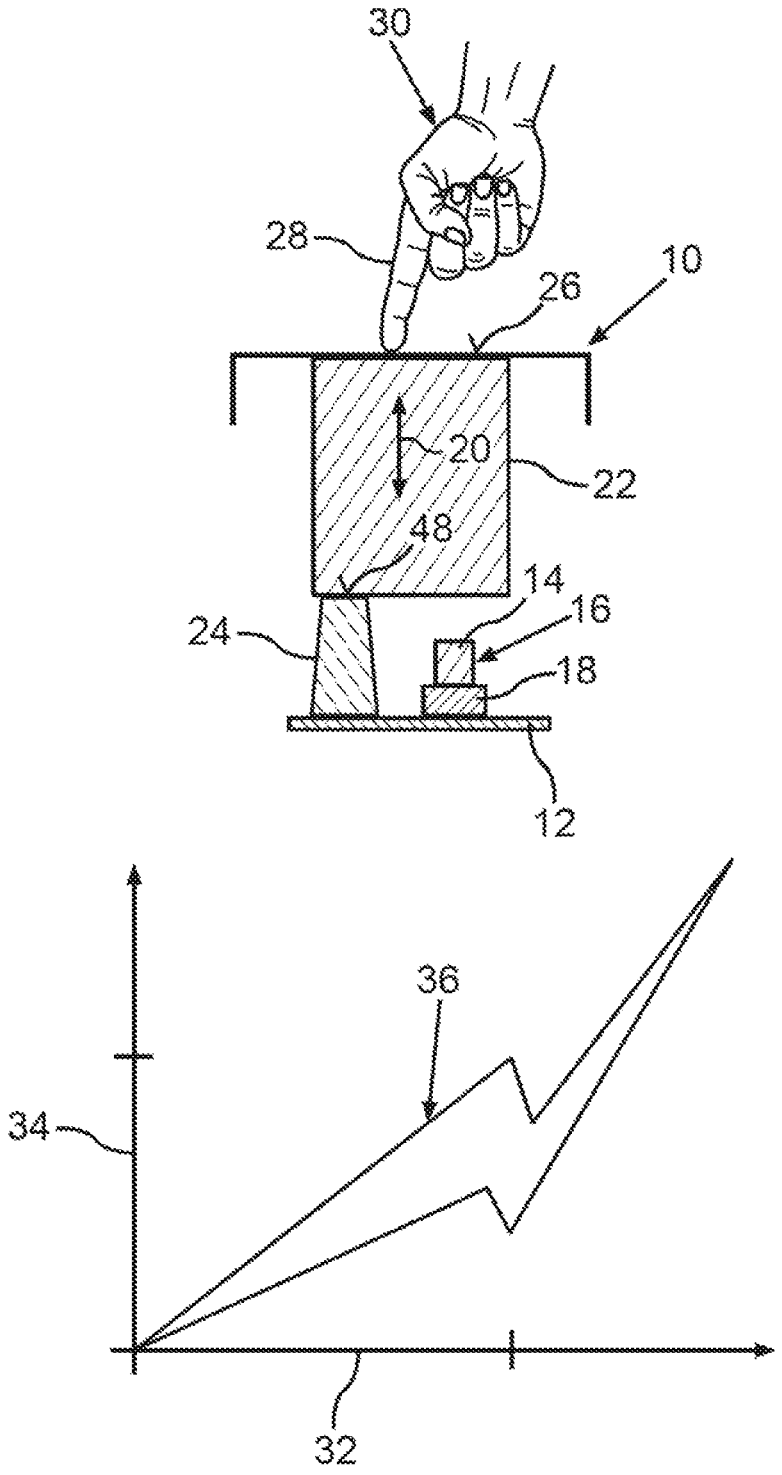
FIG. 1 is a schematic side view of an operator control device for a vehicle, in particular a passenger motor vehicle, together with an associated force/travel diagram, wherein the operator control device includes a restoring element according to a first embodiment, which is formed from silicone.

Reference will now be made in detail to example embodiments which are illustrated in the accompanying drawings, wherein like reference numerals refer to like elements throughout.

Further advantages, features and details can be found in the following description of preferred exemplary embodiments and with reference to the drawings. The features and combinations of features specified in the description and the features and combinations of features which are specified below in the description of the figures and/or merely shown in the figures can be used not only in the respectively indicated combination but also in other combinations or alone without departing from the scope of the disclosure.

In the figures, identical or functionally identical elements are provided with the same reference symbols.

FIG. 1 shows a schematic side view of an operator control device, denoted in its entirety by 10, for a vehicle, in particular a motor vehicle, and preferably a passenger motor vehicle. The operator control device 10 may include a base element 12 which is, for example, a printed circuit board. The printed circuit board can be attached to a further base element in the form of a housing part of a housing of the operator control device 10, wherein the housing is not illustrated in FIG. 1. Alternatively, the base element 12 can be the housing part itself.

The operator control device 10 may further include a switching element 14 which is embodied here as a microswitch. The microswitch (switching element 14) is, for example, part of a switching unit which is denoted in its entirety by 16 and which has a housing 18. The switching unit 16 is secured to the base element 12 by using the housing 18, wherein the switching element 14 can be moved in a translatory fashion relative to the housing 18 along a movement direction. The movement direction of the switching element 14 is illustrated in FIG. 1 by a double arrow 20. The switching element 14 can be moved relative to the base element 12 and relative to the housing 18 along the movement direction between a first position (shown in FIG. 1) and at least a second position. If the switching element 14 is moved from the first position into the second position, at least one electrical contact (not shown in FIG. 1) is closed as a result by using the switching element 14. For example, at least one function of the vehicle is brought about as a result of the closing of this electrical contact. This function may be, for example, the starting or the activation or the switching-off or deactivation of a drive assembly of the vehicle. In other words, the operator control device 10 serves, for example, to activate and deactivate the drive assembly which is embodied, for example, as an internal combustion engine.

The operator control device 10 also includes a pushbutton switch 22 which can be moved in a translatory fashion relative to the base element 12 along the movement direction. The pushbutton switch 22 can be moved here relative to the base element 12 in the movement direction between a position of rest (shown in FIG. 1) and at least one activation position (not shown in FIG. 1).

From FIG. 1 it is apparent that the switching element 14 can be moved from the first position into the second position by using the pushbutton switch 22 by moving the pushbutton switch 22 from the position of rest into the activation position, with the result that the switching element 14 can be moved from the first position into the second position by using the pushbutton switch 22. The electrical contact can therefore be closed by using the pushbutton switch 22.

The operator control device 10 furthermore includes a restoring element 24 which is supported on the base element 12 and on the pushbutton switch 22 and can be or is elastically deformed by moving the pushbutton switch 22 from the position of rest into the activation position. The pushbutton switch 22 can be moved from the activation position into the position of rest by using the restoring element 24 by at least partially relaxing the restoring element 24.

The pushbutton switch 22 has a surface 26 which, in order to activate, that is to say to move, the pushbutton switch 22 from the position of rest into the activation position, is touched by a person, for example by using a finger 28 of their hand 30. The person applies, by using their finger 28, a force to the surface 26 which acts along the movement direction in the direction of the base element 12, and therefore on the pushbutton switch 22, with the result that the person presses the pushbutton switch 22 with their finger 28. As a result, the pushbutton switch 22 is moved relative to the base element 12 along the movement direction toward the base element 12, as a result of which the restoring element 24 is deformed and is compressed here. The restoring element 24 is arranged specifically between the base element 12 and the pushbutton switch 22.

As a result of the deformation of the restoring element 24, the latter is elastically deformed in the activation position of the pushbutton switch 22 and therefore tensioned, with the result that the tensioned restoring element 24 applies a further force, in particular a spring force, to the pushbutton switch 22 in the activation position of the pushbutton switch 22. This further force counteracts the force which the person applies to the pushbutton switch 22 with their finger 28. By using the force applied to the pushbutton switch 22 by the person, the pushbutton switch 22 can be held in the activation position, for example counter to the further force. If the person releases the pushbutton switch 22, that is to say if the person no longer applies force to the pushbutton switch 22, the restoring element 24 can at least partially relax, with the result that the pushbutton switch 22 is moved from the activation position back into the position of rest along the movement direction by using the further force, that is to say by using the restoring element 24. The position of rest is also referred to as the zero position, wherein the restoring element 24 makes available a restoring function in the scope of which the pushbutton switch 22 which functions as an operator control element is moved back into the zero position.

During the movement of the pushbutton switch 22 between the position of rest and the activation position, the pushbutton switch 22 carries out a stroke. This stroke is a distance or a travel which the pushbutton switch 22 moves along or executes during its movement from the position of rest into the activation position. As the distance increases from the position of rest, that is to say as the pushbutton switch 22 moves increasingly from the position of rest in the direction of the activation position, the restoring element 24 is increasingly deformed and compressed here. As a result, the further force which counteracts the movement of the pushbutton switch 22 and is brought about by the restoring element 24 increases as the distance increases, with the result that the force which is applied to the pushbutton switch 22 by the person also has to increase as the distance increases in order to be able to move the pushbutton switch 22 completely into the activation position.

FIG. 1 shows a force/travel diagram, on the abscissa 32 of which the distance which is traveled by the pushbutton switch 22 is entered, wherein this distance is also referred to as travel. The force which is applied to the pushbutton switch 22 by the person is entered on the ordinate 34 of the force/travel diagram. A profile 36 illustrates here the force which is applied to the pushbutton switch 22 by the person during the movement of the pushbutton switch 22 from the position of rest into the activation position.

The pushbutton switch 22 is used in order to implement particularly simple operator control of the operator control device 10, since, for example, the surface 26 can be made particularly large by using the pushbutton switch 22. At the same time, the switching unit 16 can be made particularly small in terms of its dimensions, with the result that, for example, the size and the weight of electrical contact-forming elements can also be kept small.

In order then to implement particularly precise and advantageous operator control of the operator control device 10, in particular of the pushbutton switch 22, the restoring element 24 is formed from silicone. In this context, the restoring element 24 is embodied in such a way that—as is apparent from the profile 36—the force for moving the pushbutton switch 22 from the position of rest into the activation position increases linearly at least in a part, in particular at least in a major part, of the distance as the movement of the pushbutton switch 22 increases in the direction of the activation position. In other words—as is apparent from the profile 36—an at least virtually linear force profile can be formed during the activation of the pushbutton switch 22, wherein here the at least essentially linear force profile is implemented in such a way that the silicone element is embodied so as to be similar to a switching mat dome. On the basis of the design or geometry of the restoring element 24, its deformation behavior can be adjusted according to requirements, with the result that, for example, an at least substantially linear force profile can be implemented. Here, the restoring element 24 which is embodied as a silicone element ensures, together with the electric switching element 14, an at least approximately linear force profile or rise in force of the pushbutton switch 22 which is embodied as a longitudinal stroke/operator control element, up to an electrical switching point at which the electrical contact is finally closed, on the basis of the interaction of the switching element 14, embodied, for example, as a microswitch, and the restoring element 24.

FIG. 1 shows a first embodiment of the operator control device 10, in particular of the restoring element 24. In the first embodiment, the restoring element 24 has a cross section which is embodied in a varying fashion along the movement direction, wherein the restoring element 24 is embodied here in the form of a truncated cone. Different specific embodiments of the restoring element 24 are described above and below. Of course, the restoring element 24 can also be configured in another way.

Figure 2:
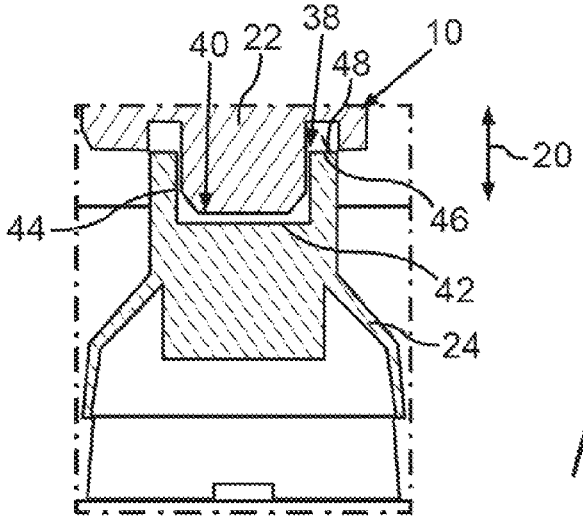
FIG. 2 is a detail of a schematic sectional view of the operator control device according to a second embodiment.

FIG. 2 shows a detail of a sectional view of a second embodiment of the operator control device 10, in particular of the restoring element 24. The restoring element 24 has, on its end side 38 facing the pushbutton switch 22, a recess 40 in which the pushbutton switch 22 is partially accommodated. The recess 40 has here a base 42 and a side wall 44 which are formed by the restoring element 24 which may be embodied in one piece. From FIG. 2 it is apparent that in the second embodiment the recess 40 extends at least substantially in a straight fashion and at the same time is embodied, for example, in the form of a straight circular cylinder.

Figure 3:
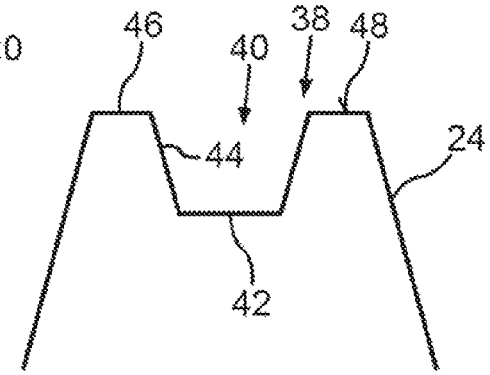
FIG. 3 shows a schematic sectional view of the restoring element according to a third embodiment.

FIG. 3 shows a schematic sectional view of a third embodiment of the restoring element 24. In the third embodiment, the restoring element 24 also has on its end side 38 the recess 40 which, however, now tapers away from the pushbutton switch 22 (not shown in FIG. 3) in the movement direction. For this purpose, the side wall 44 does not extend, as in the second embodiment, in a straight fashion or in parallel with the movement direction but rather obliquely with respect to the movement direction.

Figure 4:
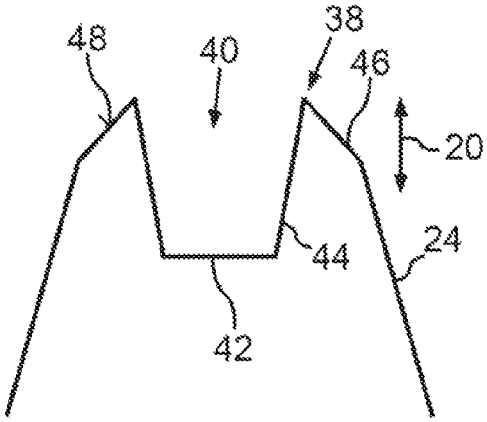
FIG. 4 shows a schematic sectional view of the restoring element according to a fourth embodiment.

FIG. 4 shows a fourth embodiment which corresponds basically to the third embodiment, with the difference that a wall region 46 of the restoring element 24 adjoins the side wall 44, wherein the wall region 46 extends obliquely with respect to the movement direction. Therefore, an end face 48 which is formed by the wall region 46 extends obliquely with respect to the movement direction.

Figure 5:
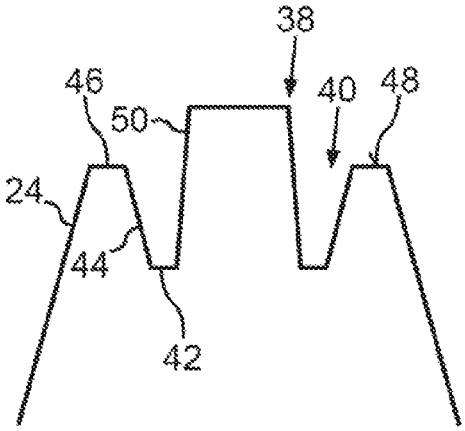
FIG. 5 shows a schematic sectional view of the restoring element according to a fifth embodiment.

FIG. 5 shows a fifth embodiment of the restoring element 24. In the fifth embodiment, a projection 50 is arranged in the recess 40, wherein the recess 40 surrounds the projection 50, for example, at least essentially in an annular shape. The projection 50 is therefore spaced apart from the wall region 46. In the fifth embodiment, the end face 48 extends, as in the second, third and first embodiments, at least substantially perpendicularly with respect to the movement direction.

The projection 50 can be embodied in the form of a truncated cone and has an extent, in particular length, which extends in the movement direction and is larger than a depth, extending in the movement direction, of the recess 40, with the result that in the fifth embodiment the projection 50 projects out of the recess. The projection 50 therefore projects beyond the end face 48.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in Superguide v. DIRECTV, 358 F3d 870, 69 USPQ2d 1865 (Fed. Cir. 2004).

The invention claimed is:

1. An operator control device for a motor vehicle, the operator control device comprising:

a base element;

a switching element moveable relative to the base element from a first position into a second position to thereby close at least one electrical contact;

a pushbutton switch moveable relative to the base element in a movement direction between a rest position and an activation position, the switching element moveable from the first position into the second position by moving the pushbutton switch from the rest position into the activation position, and a silicone restoring element, supported on the base element and on the pushbutton switch, and elastically deformable by moving the pushbutton switch from the rest position into the activation position, the pushbutton switch moveable from the activation position into the rest position by at least partially relaxing the silicone restoring element, the silicone restoring element having a shape of a truncated cone at least in a partial region, and having, on an end side facing the pushbutton switch, a recess which tapers along the movement direction in a direction pointing away from the pushbutton switch, the recess including:

a base, a side wall adjoining the base, and a wall region adjoining the side wall and extending obliquely with respect to the movement direction such that an end face of the wall region extends obliquely with respect to the movement direction.

2. The operator control device according to claim 1, wherein, when the pushbutton switch moves from the rest position into the activation position along the movement direction, the pushbutton switch travels a distance, and a force required to move the pushbutton switch from the position of rest into the activation position increases linearly, at least in part of the distance with increasing movement of the pushbutton switch toward the activation position.

3. The operator control device according to claim 1, wherein the restoring element has a cross section which varies along the movement direction.

4. The operator control device according to claim 1, wherein the silicone restoring element further includes a projection, disposed in the recess, which projects toward the pushbutton switch.

5. The operator control device according to claim 4, wherein the projection projects out of the recess.

6. The operator control device according to claim 1, wherein the silicone restoring element further includes a projection, disposed in the recess, which projects toward the pushbutton switch, and the projection has a length extending in the movement direction from the base of the recess which is greater than a depth of the recess in the movement direction.

7. The operator control device according to claim 6, wherein the projection has a shape of a truncated cone.

8. The operator control device according to claim 1, wherein in the rest position the pushbutton switch is spaced apart from the switching element in the movement direction, and when the pushbutton switch receives a force to move the pushbutton switch in the movement direction toward the activation position, the pushbutton switch travels a distance before contacting the switching element.

9. A motor vehicle, comprising:

a chassis; and an operator control device, including:

a base element;

a switching element moveable relative to the base element from a first position into a second position to thereby close at least one electrical contact;

a pushbutton switch moveable relative to the base element in a movement direction between a rest position and an activation position, the switching element moveable from the first position into the second position by moving the pushbutton switch from the rest position into the activation position, and a silicone restoring element, supported on the base element and on the pushbutton switch, and elastically deformable by moving the pushbutton switch from the rest position into the activation position, the pushbutton switch moveable from the activation position into the rest position by at least partially relaxing the silicone restoring element, the silicone restoring element having a shape of a truncated cone at least in a partial region, and having, on an end side facing the pushbutton switch, a recess which tapers along the movement direction in a direction pointing away from the pushbutton switch, the recess including:

a base, a side wall adjoining the base, and a wall region adjoining the side wall and extending obliquely with respect to the movement direction such that an end face of the wall region extends obliquely with respect to the movement direction.

10. The motor vehicle according to claim 9, wherein, the pushbutton switch is configured to travel a predefined distance from the rest position to the activation position along the movement direction, and the pushbutton switch is configured such that as the pushbutton switch moves toward the activation position, the pushbutton switch linearly increases resistance of displacement in the movement direction over at least part of the predefined distance.

11. The motor vehicle according to claim 9, wherein the restoring element has a cross section which varies along the movement direction.

12. The motor vehicle according to claim 9, wherein the silicone restoring element further includes a projection, disposed in the recess, which projects toward the pushbutton switch.

13. The motor vehicle according to claim 12, wherein the projection projects out of the recess.

14. The motor vehicle according to claim 9, wherein the silicone restoring element further includes a projection, disposed in the recess, which projects toward the pushbutton switch, and the projection has a length extending in the movement direction from the base of the recess which is greater than a depth of the recess in the movement direction.

15. The motor vehicle according to claim 14, wherein the projection has a shape of a truncated cone.

16. The motor vehicle according to claim 9, wherein in the rest position the pushbutton switch is spaced apart from the switching element in the movement direction, and when the pushbutton switch receives a force to move the pushbutton switch in the movement direction toward the activation position, the pushbutton switch travels a distance before contacting the switching element.

* * * * *